US009370057B2

(12) United States Patent
Saes et al.

(10) Patent No.: US 9,370,057 B2
(45) Date of Patent: Jun. 14, 2016

(54) INTERFACE CIRCUIT FOR A LIGHTING DEVICE

(75) Inventors: Marc Saes, Eindhoven (NL); Petrus Johannes Maria Welten, Oss (NL)

(73) Assignee: ELDOLAB HOLDING B.V., Son En Breugel (NL)

( * ) Notice: Subject to any disclaimer, the term of this patent is extended or adjusted under 35 U.S.C. 154(b) by 393 days.

(21) Appl. No.: 13/816,447

(22) PCT Filed: Aug. 9, 2011

(86) PCT No.: PCT/NL2011/050554

§ 371 (c)(1), (2), (4) Date: Aug. 21, 2013

(87) PCT Pub. No.: WO2012/021060

PCT Pub. Date: Feb. 16, 2012

(65) Prior Publication Data

US 2013/0320875 A1 Dec. 5, 2013

Related U.S. Application Data

(60) Provisional application No. 61/373,006, filed on Aug. 12, 2010.

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0815* (2013.01); *H05B 33/0818* (2013.01); *H05B 37/0254* (2013.01)

(58) Field of Classification Search

CPC .. H04B 10/116; H04B 5/0037; H04B 10/541; H05B 37/0245; H05B 37/0272; H05B 33/0815; H05B 33/0842; H05B 33/0854; H05B 33/0869; H05B 37/0218; H05B 33/08; H05B 33/0845; H05B 33/086; H05B 37/02; H05B 37/0227

USPC ..... 315/224, 291, 292, 314, 316

See application file for complete search history.

(56) References Cited

U.S. PATENT DOCUMENTS

| | | | | |
|---|---|---|---|---|
| 4,628,428 | A * | 12/1986 | Walker | 363/21.16 |
| 7,619,539 | B2 * | 11/2009 | Veskovic et al. | 340/4.3 |
| 2005/0179404 | A1 | 8/2005 | Veskovic et al. | |
| 2008/0276154 | A1 | 11/2008 | Hick et al. | |
| 2009/0079362 | A1 | 3/2009 | Shteynberg et al. | |

FOREIGN PATENT DOCUMENTS

WO 2009133489 A1 11/2009

* cited by examiner

*Primary Examiner* — Lincoln Donovan
*Assistant Examiner* — Diana J Cheng
(74) *Attorney, Agent, or Firm* — Browdy and Neimark, P.L.L.C.

(57) ABSTRACT

An interface circuit for a lighting device is described, the interface circuit comprising

- a single input terminal for receiving a input signal from a user interface;
- an output terminal for providing a control signal for controlling the lighting device,
- a detection circuit for receiving the input signal and identifying whether the input signal is either an analog 0-10V signal, a DALI protocol signal or a mains signal and
- a converter circuit for converting the input signal to the control signal based on the identification, and provide the control signal to the output terminal.

The interface as described facilitates retrofitting existing lighting applications.

17 Claims, 6 Drawing Sheets

INTERFACE CIRCUIT FOR A LIGHTING DEVICE

BACKGROUND

At present, conventional lighting devices such as halogen lights are often replaced by more advanced lighting devices such as LED based lighting devices having an increased functionality.

In order to obtain this increased functionality, LED based lighting devices are often controlled by particular communication protocols such as DALI or DMX which are provided via a communications bus.

At present, various communication interfaces exist for controlling various types of lighting devices which renders retrofitting an existing installation to a different type of communication protocol or lighting device often difficult and expensive.

As such, efforts have been made to adjust a communication interface such that various types of communication protocols can be applied.

In this respect, reference can be made to US 2010/0102747 describing a communication interface which can accept both 0-10V or DALI signals as input signals.

The DALI (Digital Addressable Lighting Interface) interface is specified in the IEC 60929 standard for fluorescent lamp ballasts.

On the DALI system a variant is known with which it is possible to use the DALI interface either as a conventional DALI interface (providing signals according to the DALI protocol) or as a switch interface. In case of the system operating as 'switch interface', the 2 DALI wires are connected to a mains connection (e.g. 230 VAC) via a switch. Pressing the switch will cause the DALI interface to produce 100 Hz digital pulses to the lighting fixture. The software inside the lighting fixture is written such that it can distinguish between a DALI interface and the 'switch interface'.

In case of the DALI interface it will function according to the DALI protocol standard.

In case of the 'switch interface', it will count numbers of 100 Hz pulses during certain periods of time.

At present, it can be stated that the flexibility of known communication interfaces w.r.t. accepting different types of input signals, is however still limited.

As such, it is an object of the present invention to improve this flexibility.

SUMMARY OF THE INVENTION

In accordance with an aspect of the present invention, there is provided an interface circuit for a lighting device, the interface circuit comprising

- a single input terminal for receiving a input signal from a user interface;
- an output terminal for providing a control signal for controlling the lighting device,
- a detection circuit for
  - receiving the input signal or a signal representative thereof and
  - identifying whether the input signal is either an analogue 0-10V signal, a DALI protocol signal or a mains signal and
- a converter circuit for converting the input signal to the control signal based on the identification, and
  provide the control signal to the output terminal.

In accordance with the present invention, an interface circuit (or interface) is provided that facilitates installation, e.g.

retrofitting of lighting devices such as LED fixtures. The interface enables lighting devices to be controlled by a variety of known input signals, which input signals may, according to the invention, be provided at a single input terminal of the interface circuit. As such, installation is facilitated since there is only one terminal to which the input signal can be coupled. In accordance with the present invention, the interface is adapted to at least process the following types of input signals:

- a DALI protocol signal,
- an analogue signal according to the 0-10V standard,
- a (switched) mains signal.

The input signal as received by the interface circuit according to the invention may thus be provided by a DALI interface (which can provide standard DALI protocol signals or, when available, provide a mains input signal thereby operating as a switch interface), a DC source interface (which may by either a passive or active DC source providing an analogue 0-10V signal) or even a conventional lighting switch or e.g. a push-button providing a mains signal.

In the latter case, the mains signal can e.g., via a switch, be provided by a mains supply which is at the same time used for supplying the lighting device. When a mains signal is provided, the interface may, in an embodiment, be arranged to operate as a switch interface as described above. Such behavior is also known as switch-dim operation whereby the mains input signal (e.g. 230 VAC) is converted to pulses, e.g. 100 Hz pulses in case of a 50 Hz mains supply.

In such an embodiment, the interface can co-operate with a DALI interface as described above whereby the input signal may either be a signal according to the DALI protocol standard or may be a mains voltage, e.g. upon operation of a switch of the DALI interface. In such an embodiment, the converter circuit of the interface circuit according to the invention can be provided with a switch-dim circuit for converting a mains input signal to e.g. 100 Hz. pulses. Such (100 Hz) pulses may thus constitute the control signal as provided at an output terminal of the interface circuit according to the invention. When a lighting device (e.g. an LED based lighting device) is coupled to the interface according to the invention such that the pulses are received at e.g. an input terminal of a control unit of the lighting device, the pulses can be interpreted by the control unit to control the lighting device in a particular manner. Various options exist:

As an example, it is assumed that a DALI interface is used to provide the input signal for the interface according to the invention, the DALI interface including a switch (which can be a conventional lighting switch, such that, when the switch is pressed, a mains voltage is provided as an input signal of the interface whereupon the interface provides the (100 Hz) pulses. As a first possible behavior, as long as these pulses are received, the dimming level is increased from 0 (or from the level it was at prior to closing the switch) until 100% is reached. In case the switch is opened, the last dimming level is used as the steady state level until the switch is closed again. When the switch has been opened for a certain minimum period and closed again, the change of the dimming level is resumed in the same direction as before when it was not at 100% or at 0%. Otherwise the opposite direction is chosen.

As a second example, a simple protocol can be devised, like for example 2 closures of the switch within 1 second with an open period in between of a minimum length, through which it is possible to switch towards a color mode and change the color on the subsequent closure. etc.

As an alternative, the converter circuit of the interface according to the invention can be arranged to convert the array of (100 Hz) pulses to a set point for the lighting device. This set point may subsequently be provided, via the output terminal, to a control unit of the lighting device as a control signal. In such an embodiment, the conversion of the array of pulses to a set point need not be performed by the lighting device's control unit.

By adding the 'switch interface' or switch dim operation to the operation using the DALI protocol, one is able to introduce DALI capable lighting units in old installations, operating them in the conventional way using old cabling and converting later to DALI interfacing. For example by gradually replacing cables when not DALI compatible or interfacing them to a (to be added) DALI controller in stead of to a 230V switch when the cables were already DALI compatible.

In accordance with the present invention, the interface according to the invention is also capable of processing analogue 0-10 V signals as input signals. By doing so, an improved flexibility with respect to retrofitting is obtained as it enables DALI interfaces (which e.g. combine standard DALI protocol behavior and enable switch-dim control) to be connected to 0-10V carrying cables in comparatively old installations. This would mean an easy retrofit of DALI devices in such installations with the ability to convert to DALI later on just as in the previous case.

In an embodiment, the interface according to the invention comprises a PWM circuit for converting a 0-10V input signal to a PWM output signal, e.g. having a duty cycle which is proportional to the analogue 0-10V input signal.

Among the solutions for merging DALI devices into 0-10V installations is the one disclosed in application US 2010/0060194 A1 in which a DALI to 0-10V converter is implemented in the cable delivering 0-10V to the lighting fixture.

Reference can also be made to US 2010/0102747 describing a communication interface which can accept both 0-10V or DALI input signals.

An important aspect to enable proper operation of an interface which can accept various types of input signals is how to identify which type of signal is provided at the input of the interface.

In order to detect which input signal is presented at the input terminal, the interface circuit according to the invention comprises a detection circuit. various options exist. The identification of the type of input signal (e.g. either a standard DALI signal, an analogue 0-10V signal, a mains signal or a DMX signal) can e.g. be based on the amplitude of the signal but may also be based on a detection of the impedance of the source providing the input signal. In order to determine the impedance, a comparatively small current may e.g. be injected at the input terminal by a current source of the interface circuit. Such a current source may e.g. be provided in the interface circuit in order to obtain an input signal of a passive DC source (e.g. a variable resistor).

It can further be noted that the interface circuit according to the invention can be adapted to accommodate a change from one type of input signal (e.g. an analogue 0-10V signal) to another type of signal (e.g. a signal according to the DALI protocol). Upon detection of such a change of the type or kind of input signal, the interface circuit according to the invention may change it's operating mode. Below, various finite state machines are described which may be implemented in software and applied in the detection circuit of the interface according to the invention and which describe a possible change in operating state or mode of the interface circuit.

In an embodiment, the interface circuit is provide with one or more optocouplers for coupling the output signal to a control unit of a lighting device in a galvanically separated manner. In this regard, it is worth mentioning that various arrangements of the converter circuit and the detection circuit are feasible, which are explained in more detail below. As a first example, the detection circuit can be galvanically connected, whereby the detection circuit controls the converter circuit based on a direct assessment of the input signal. As a second example, the detection circuit (which may e.g. take the form of a microprocessor or microcontroller can be galvanically separated from the converter circuit. In such example, the input signal can be processed by the converter circuit and provided, via a galvanic separation, to the detection circuit. Based on the signal received, the detection circuit can control, via the same or a different galvanic separation, the converter circuit.

DESCRIPTION

According to the invention, an interface circuit is provided which is at least compatible with 3 existing interfaces which are DALI, an analogue 0-10V interface and a mains supply, whereby the latter can either be provided via a conventional lighting switch or push-button to the interface or is provided by operating a DALI interface as a switch interface. In accordance with the invention, the signal of either one of these interfaces is provided to the same input terminal of the interface.

Figure 1:
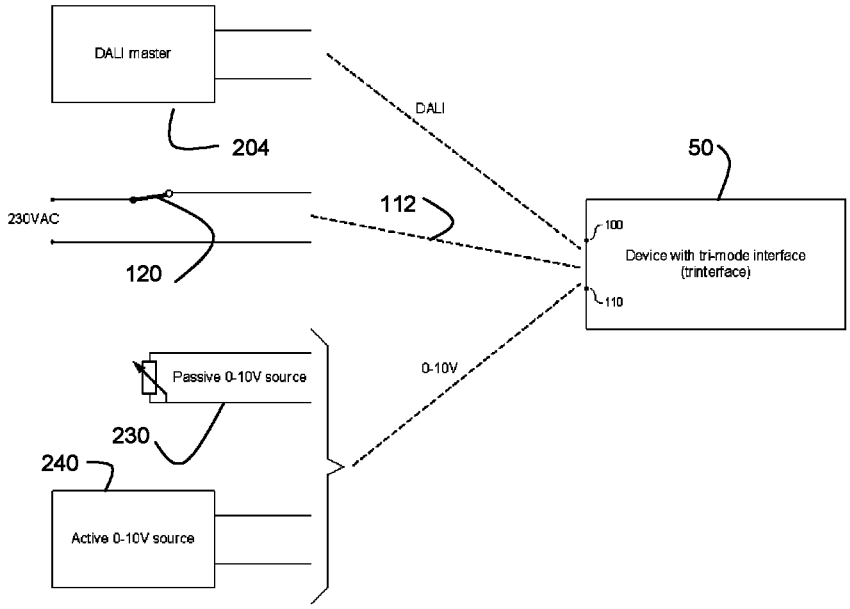
FIG. 1 schematically depicts an embodiment of an interface according to the invention and possible input signals for the interface.

In FIG. 1, the interface circuit 50 is schematically depicted including possible input signals which can be provided at the input terminal 100-110 of the interface. At the input terminal either a DALI input signal (e.g. from a DALI master 204), a mains signal 112 upon closing of a switch 120, or an analogue 0-10V signal, either from a passive 230 or an active 240 0-10V source can be received.

In order to assess which type of input signal is applied at the input terminal of the interface circuit, the interface circuit according to the invention comprises a detection circuit. The detection circuit can e.g. comprise a sensor for sensing a property of the input signal, such as a voltage amplitude or an impedance of the source supplying the input signal. As an alternative, or in addition, the detecting circuit can be arranged to analyze the input signal in order to identify the type of signal. As such, the detecting circuit can comprise a microprocessor for analyzing the input signal. Based upon said sensing enabling an identification of the type of input signal the interface circuit according to the invention may operating in various modes or states. In case the type of input signal changes, i.e. a switch is made from one type of input signal (e.g. an analogue 0-10V signal) to another type of signal (e.g. a signal according to the DALI protocol), the interface circuit according to the invention can address such a change by changing it's operating state. Several algorithms have been devised for providing such a transition in operating state. These algorithms are explained in more detail below by way of finite state machines. The algorithms can e.g. be implemented in a microcontroller of a detection circuit of the interface according to the invention. As a result, the interface according to the invention is capable of automatically distinguishing which of the 3 interfaces are connected as a peer and will automatically adapt its behavior to be compatible with the interface connected.

Figure 2:
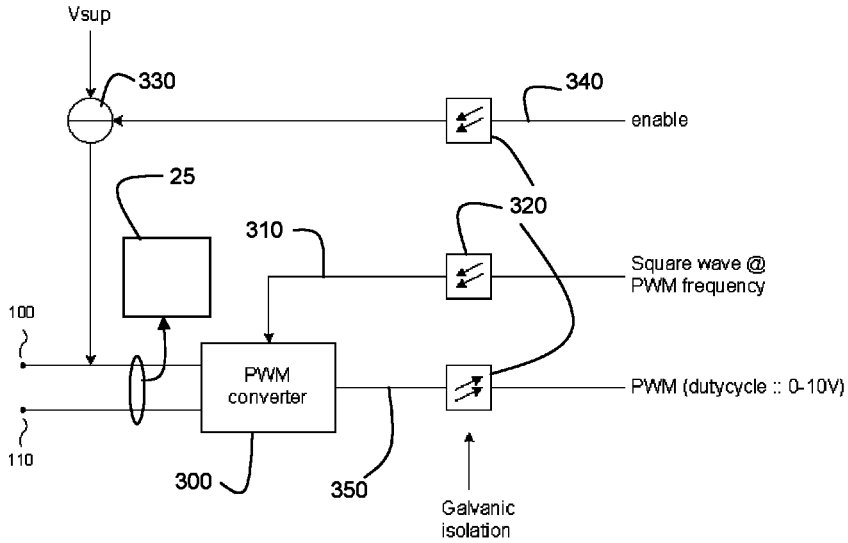
FIG. 2 schematically depicts a PWM circuit of an embodiment of the interface according to the invention for converting an analogue 0-10V signal to a PWM signal.

In FIGS. 2-5, some further details of embodiments of the interface according to the invention are schematically shown. In FIG. 2, part of an embodiment of an interface according to the invention is shown, whereby, at the input terminal 100-110, an analogue signal 0-10V is presented. The interface comprises a detection circuit 25 for identifying the type of input signal presented at the input terminal 100-110 and a PWM circuit comprising a PWM converter 300 receiving the input signal and a square wave signal 310 at a PWM frequency, which can e.g. be provided to the PWM converter via an optocoupler 320. Using the square wave signal, the analogue 0-10V signal can be converter to a PWM output signal 350 representing the input signal. The output signal 350 may be outputted via a galvanic separation, e.g. provided by an optocoupler 320. It is worth noting that the PWM converter may comprise an oscillator in order to generate the required PWM frequency. In such embodiment, a separate square wave signal 310 is thus not required.

With respect to the detection circuit 25 as indicated, it is worth mentioning that the identification may also be performed at other positions of the interface circuit, In an embodiment, the detection circuit 25 of the interface according to the invention can be galvanically separated (or isolated) from the converter circuit of the interface circuit. In such embodiment, identification of the type of input signal may be based on a signal representative of the input signal, rather than the input signal itself. As an example, the output signal of the PWM converter (indicated as PWM (dutycycle::0-10V) can e.g. be applied to identify the type of input signal as this signal may be different depending on the type of input signal (e.g. a mains signal, a DALI protocol signal or an analogue signal).

In case the 0-10V supply is a passive supply (e.g. a variable resistance or potentiometer), the circuit can be provided with a current source 330 which can be controlled by an enable signal 340, in order to provide a voltage signal at terminal 100-110. As such, the combination of the current source 330 and the PWM converter enables the analogue 0-10V signal to be converted to an output signal (indicated as PWM (dutycycle::0-10V) in FIG. 2) which is galvanically separated from the interface (and thus from the input terminal 100-110). The output signal thus generated may readily be applied in e.g. an LED driver of a lighting application as a control signal for e.g. controlling a power converter of the lighting application. It is worth noting that other arrangements for obtaining a galvanically separated output signal based on an 0-10V analogue input signal can be considered as well. As will be understood by the skilled person, a galvanic separation may also be provided by a transformer or a capacitive coupling. As such, others circuits may equally be devised that enable conversion of an analogue 0-10V signal (either from an active or passive supply) to an output signal that is galvanically separated and can be used as a control signal for an LED driver.

Figure 3:
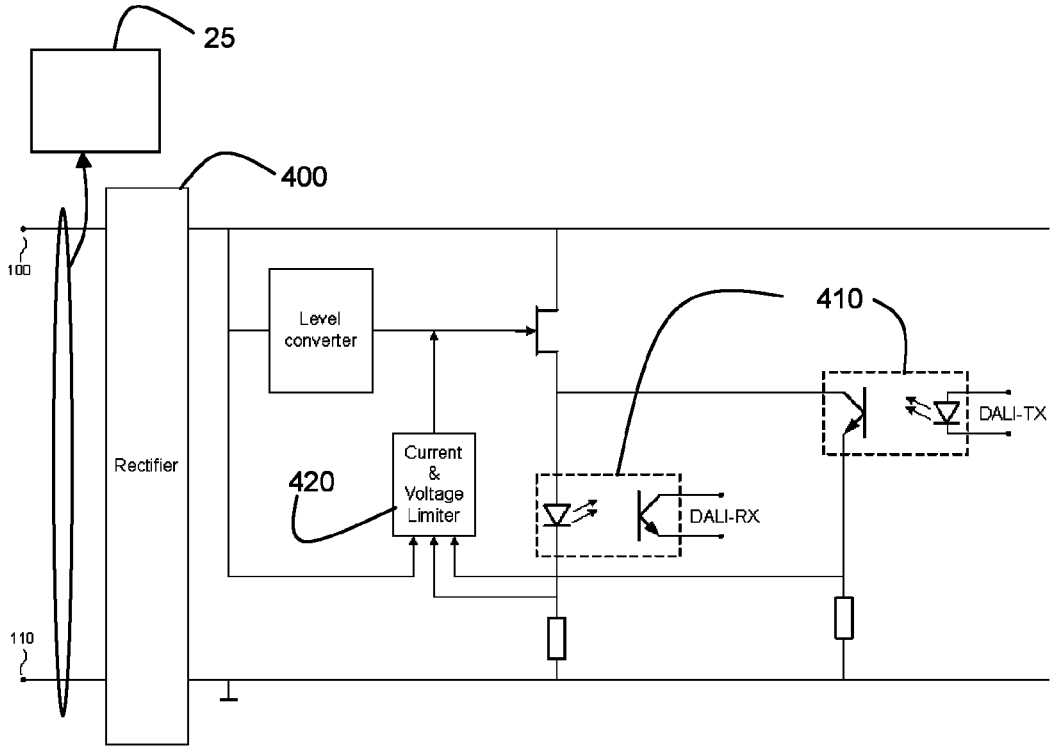
FIG. 3 schematically depicts part of an interface according to the invention adapted to process a DALI protocol input signal or a mains input signal.

In FIG. 3, part of an interface according to the invention is schematically depicted that can handle input signals of a DALI interface. Such signals may, as already stated above, be either signals according to the standard DALI protocol or may be, when the DALI interface is used as a switch interface (for switch-dim operation), a mains signal.

In the arrangement as shown, a signal presented at input terminals 100-110 is rectified by rectifier 400. In case the input signal is a signal according to the DALI protocol, which can be detected by the detection circuit 25, the signal can subsequently be outputted via optocoupler 410 to form an output signal indicated as DALI-RX. In case the signal is a mains supply signal, which may also be detected by the detection circuit 25, a voltage and current limiting circuit 420 converts the input signal (e.g. a 230V 50 Hz signal) to a signal of pulses at e.g. 100 Hz.

FIG. 3 further shows an input terminal DALI-TX which can e.g. be used to provide response signals towards a DALI master which can be connected at terminals 100-110.

As shown in FIG. 3, both the DALI-RX and DALI-TX signal are galvanically separated using an optocoupler 410.

Figure 4:
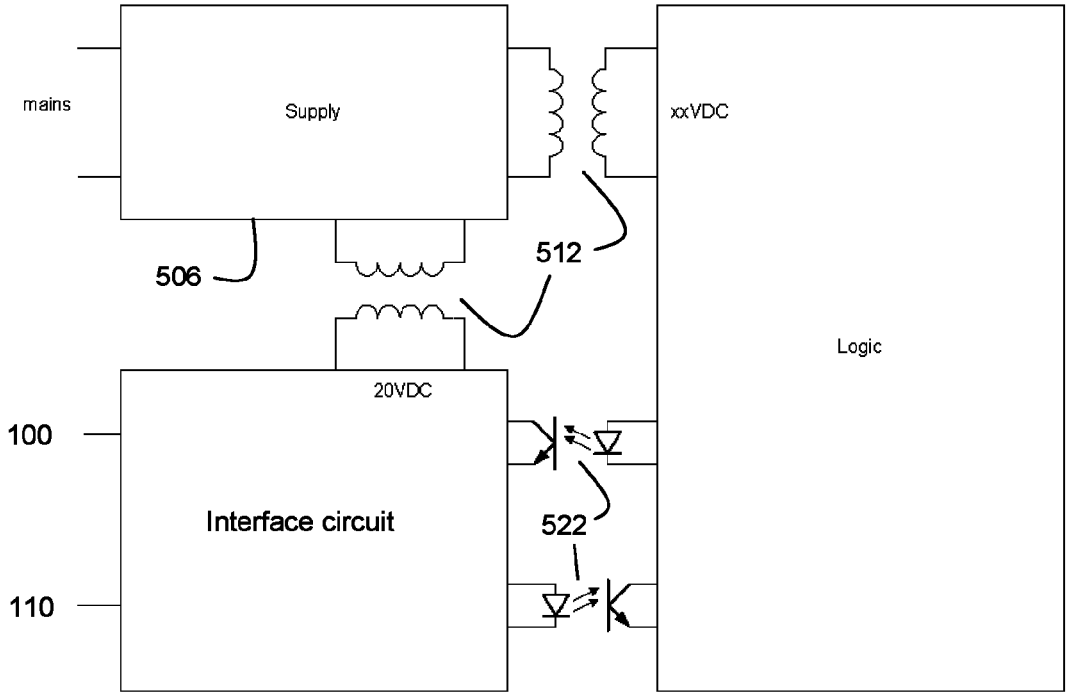
FIG. 4 schematically depicts a possible configuration of an interface according to the invention, a mains supply for powering the interface and a control unit of a lighting device.

In FIG. 4, the co-operation between an embodiment of the interface circuit 50 (having input terminals 100-110), a supply source (e.g. obtained from a mains supply) 500 and a logic component (e.g. representing a control unit of a lighting device) is depicted. In the arrangement as shown, the supply source 506 is used to supply both the interface circuit and the logic component, via separate inductive couplings 512 providing a galvanic separation between the interface circuit and the logic. As further shown, communication between the interface circuit and the logic can be bi-directional using optocouplers 522.

In an embodiment, the detection circuit of the interface circuit can be integrated in the logic component that is galvanically separated from the converter circuit (not shown) of the interface circuit.

In an embodiment, the interface according to the invention can e.g. combine the circuits and components as shown in FIGS. 2 and 3 whereby the terminals 100 and 110 are in common.

The interface according to the invention comprises a detection circuit enabling an identification of the input signal. Upon identification of the input signal, the detection circuit may enable, by means of a control signal, an appropriate part of the interface circuit for processing the input signal and converting the input signal to an output signal or, alternatively, the input signal can be processed in parallel by different parts of the interface circuit. In the former case, the detection of an analogue 0-10V signal may result in the detection circuit enabling the PWM converter.

Figure 5:
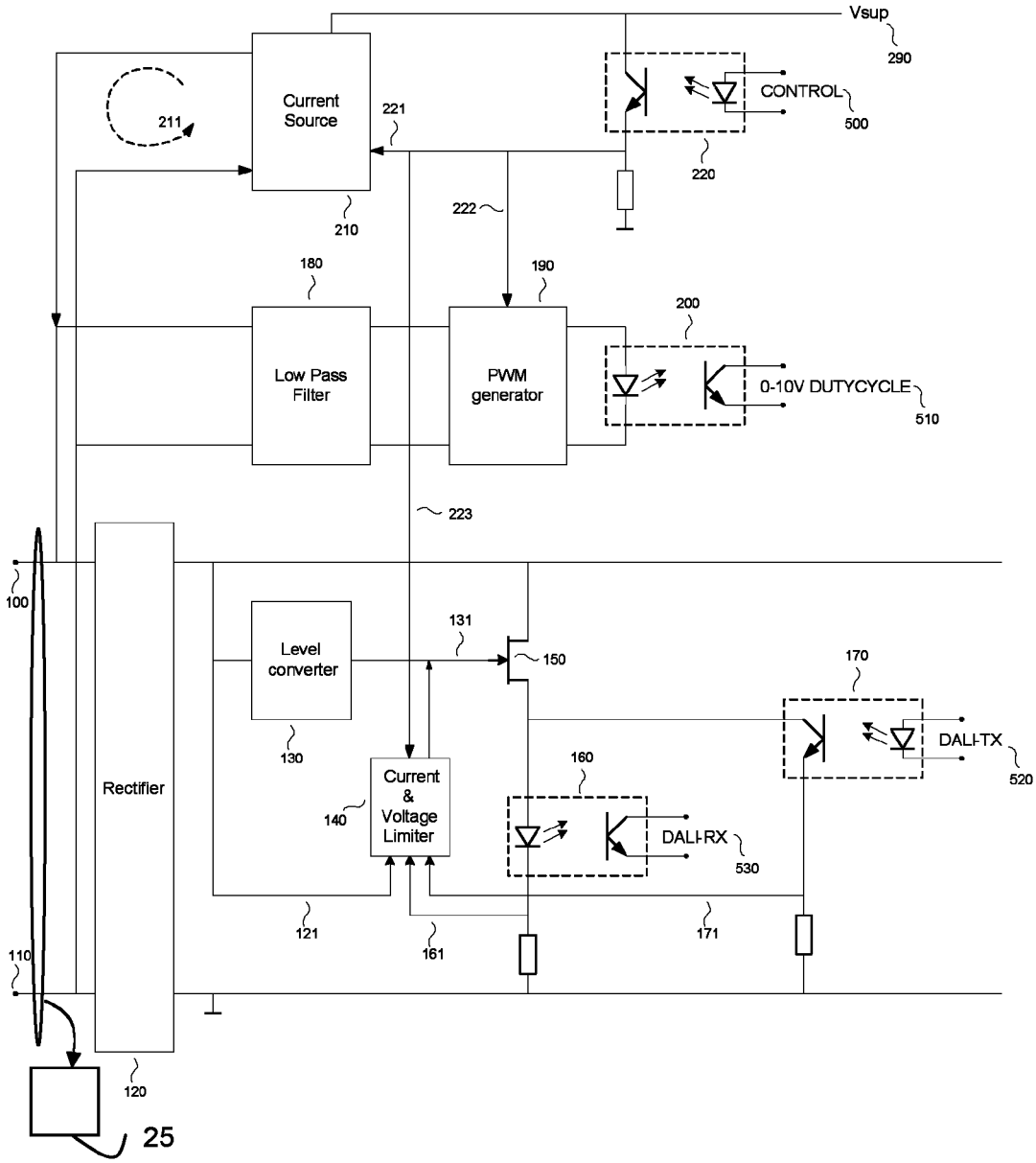
FIG. 5 schematically depicts an embodiment of an interface circuit according to the invention.

In FIG. 5, an interface circuit combining both the scheme of FIG. 2 and the scheme of FIG. 3 is shown, whereby both schemes are connected at input terminals 100-110. A detection circuit 25 is schematically depicted which is arranged to identify, based on the signal at terminal 100-110, which type of signal is presented. As already indicated above, the detection or identification of the type of input signal as provided by the detection circuit need not be obtained from the actual input signal but may be based on a signal representative thereof. As will be understood by the skilled person, depending on the type of input signal, the current or voltage signals observed at various locations of the converter circuit may be different. These differences thus provide an indication of the type of signal presented at the input terminal an may thus enable an identification of the type of input signal. As such, the detection circuit (which may e.g. be implemented as a microprocessor or microcontroller) may receive one or more input signals (e.g. via an ND conversion) which are probed on one or more locations of the converter circuit and which enable the detection circuit to identify the type of input signal and, if required, control the converter circuit accordingly. Referring to FIG. 5, the detection circuit 25 may thus be arranged to receive one or more of the outputs of the converter circuit (e.g. via the optocoupler 200 and/or 160, assess the signals and provide a control signal (indicated by CONTROL), via optocoupler 220 to control the converter circuit or one or more components of the converter circuit.

Possible outputs of the circuit are:

- a PWM signal representing a 0-10V analogue input signal which is processed via low-pass filter 180 and PWM converter 190 to the PWM signal presented as the output signal (via optocoupler 200) referred to as 0-10V DUTY CYCLE.
- Switch-dim pulses via optocoupler 160 (referred to as DALI RX), in case the input signal at terminals 100-110 is a mains voltage.
- DALI messages according to the standard DALI protocol which can be outputted via the same optocoupler 160.

As can be seen, depending on the type of input signal, the output signal may be provided at different output terminals of the interface circuit.

The interface as shown in FIG. 5 further comprises an input (indicated by optocoupler 220) at which a control signal can be provided to control the current source 210 (indicated by control signal 221). The control signal may also, as indicated in FIG. 2, be a square wave signal 222 which is applied to the PWM generator to convert an analogue input signal to the PWM signal 0-10V DUTY CYCLE.

The control signal provided at optocoupler 220 may also be applied to control the operation of the Current and Voltage limiter 140 (indicated by control signal 223). In particular, the control signal 223 may control the Current and Voltage limiter 140 in such manner that switch 150 (e.g. a FET or MOSFET) remains open, in order to limit the current drawn from the input terminals.

With respect to current source 210 which supplies a current 211 to the load present at the input terminals, it is worth mentioning that one may opt to leave this current source on at all times (taking any limitations as provided by either the 0-10V or DALI standard into account) or one may opt to turn off the current source once it becomes clear that the input signal is not an analogue 0-10V signal.

As described above, the control signal provided via input 500 can be applied for controlling one or more parts of the interface circuit. In an embodiment, the detection circuit 25 of the interface circuit can be arranged to provide the input signal, or a signal representative thereof, via an optocoupler, to a control unit of a lighting device connected to the interface. In such an arrangement, the control unit of the lighting device can be arranged to assess the input signal and determine the proper operation of the interface circuit. As such, the control unit of the lighting device may provide the control signal at the input 500 in order to control the appropriate parts of the interface circuit. Alternatively, the detection circuit 25 may identify the type of input signal at terminal 100-110 and, in response, provide the appropriate signal (221, 222 or 223) for controlling the interface circuit.

Figure 6:
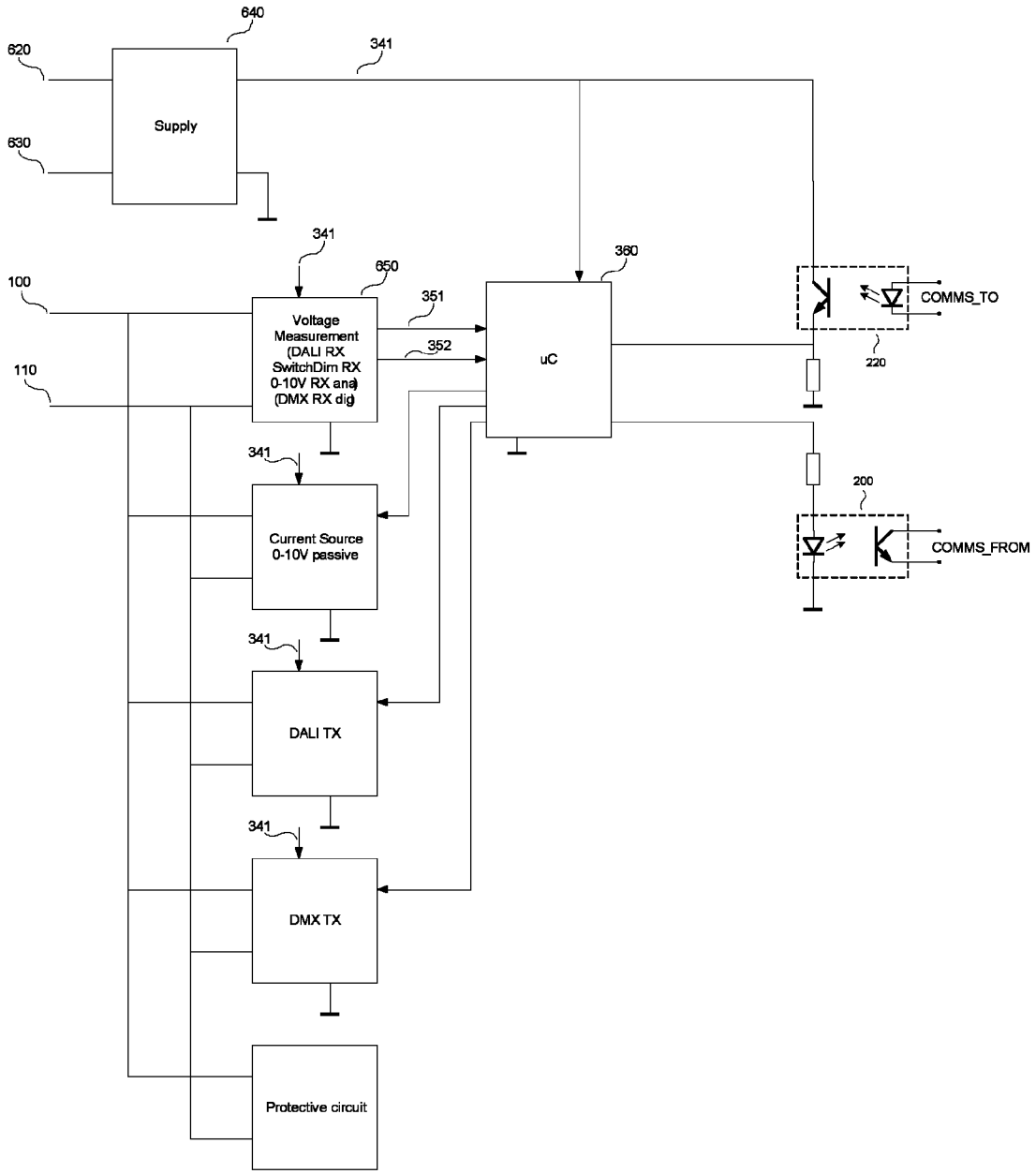
FIG. 6 schematically depicts another embodiment of an interface circuit according to the invention.

In FIG. 6, yet another arrangement of the interface circuit according to the invention is schematically depicted. In the arrangement as shown, a microcontroller 360 acting as (part of) the detection circuit of the interface circuit has been positioned at the same side of the galvanic isolation as the input signal 100-110. The microprocessor is supplied by supply 640 which can e.g. be a fly-back converter withstanding 4 kV for standards compliance. The galvanic isolation using opto-couplers 200 and 220 provides a barrier between the interface circuit and e.g. an LED driver (not shown) of an LED based lighting application that uses the output signal or signals of the interface circuit to control the lighting application. The microcontroller 360 can communicate through these opto-couplers using a standard serial communications protocol. In variations to this embodiment, the function of the opto-couplers can also be obtained using inductors or capacitors etc., or using other optical means such as separate transmitters/receivers coupled to plastic or glass fiber. In the arrangement as shown, a voltage measurement unit is shown to measure the incoming voltage at input terminal 100-110 (semi-)instantaneously. In this way the microcontroller 360 can employ software algorithms to analyze the incoming waveform and deduce the type of input signal received and thus the interface at hand from that. In case the changes on the waveform are to fast for the ADC in the microcontroller to follow, the signals are digital in nature and a simple and faster threshold detection can be employed. This is for example the case for DMX signals.

An advantage of the direct assessment of the input signal received at terminal 100-110 is that the microcontroller can now apply the value of the incoming voltage as a discriminator to determine/identify the input signal type. This will only be done if detection of the connected interface cannot be done using a more limited voltage range combined with analysis of the resulting pulse behaviour. Limiting the voltage range to the bare minimum is cheaper and allows for a combined protection circuit. The following table (table 1) provides an overview of typical voltage ranges (left column) and the corresponding types of the communication interface connected at the input terminal (right column). In response to the identification of the type of input signal, actions as indicated in the right column of the table can be taken, in addition to the detection circuit controlling certain part of the converter circuit.

TABLE 1

| | |
|---|---|
| 22.5 :: 230 | (colour)switch-dim input signal.<br>Action: Check for mains-related pulses. As the lowest voltage to be expected is e.g. 115-20%, a rough threshold may be used to discriminate between this range and the next. |
| 10 :: 22.5 | DALI input signal.<br>Action: Check for DALI messages. |
| 9.5 :: 10 | DALI or 0-10 V analog input input signal.<br>Action: Check for DALI messages. If none, assume 0-10 V analog. If a DALI msg is received after all, switch to DALI until next reset. |
| 6.5 :: 10 | 0-10 V analog input signal. |
| 0 :: 6.5 | DALI or 10 V analog input.<br>Action: Check for DALI messages. If none, assume 10 V analog. If a DALI message is received after all, switch to DALI until next reset. |
| −6.5 :: 0 | DALI.<br>Action: Check for DALI messages. |
| −9.5 :: −6.5 | illegal. Define behavior at will as this should never occur. |
| −22.5 :: −9.5 | DALI.<br>Action: Check for DALI messages. |
| −230 :: −22.5 | (colour)switch dim.<br>Action: Check for mains-related pulses. As the lowest voltage to be expected is 115-20%, a rough threshold may be used to discriminate between this range and the preceding range. |

It is worth noting that by making the above table symmetric around zero, reversed connected 0-10V analog signals can be processed also, and, by applying a rectifier, the negative voltages fold to the positive voltage and symmetry is forced. In FIG. 6, a voltage measurement unit is 650 is further shown which may be supplied via connection 341 by the supply 640 which can be applied to provide the input signal to the microprocessor 360, e.g. via an ND conversion.

As further indicated in FIG. 6, the converter circuit can be equipped with a current source in order to provide an input signal in case a passive 0-10V supply is used at the input terminal 100-110. The circuit may, as indicated, also be equipped with a DALI-TX and DMX-TX circuit for receiving DALI or DMX messages as can be provided by an LED driver co-operating with the interface. These circuits may equally be powered by the supply 340 via connection 341 as indicated. In addition, the circuit is equipped with a galvanically isolated communication interface (200, 220) for sending (indicated by COMMS_TO) and receiving messages (indicated by COMMS_FROM) by the interface. This interface may (as also discussed with respect to FIG. 5) be used to provide the converted input signal (e.g. converter to a PWM signal or switch-dim pulses) as an output signal to an LED driver co-operating, via the optocoupler 200, with the interface.

The circuit as shown further comprises a protection block to indicate that care should be taken to keep gate voltages in range and that all circuit components should be dimensioned properly, in view of the possible input signals; i.e. ranging from a mains input signal to an analogue 0-10V signal. It is assumed that the protection block also handles any common mode protection for the DMX (e.g. RS-422/RS-485) driver which may be applied.

Figure 7:
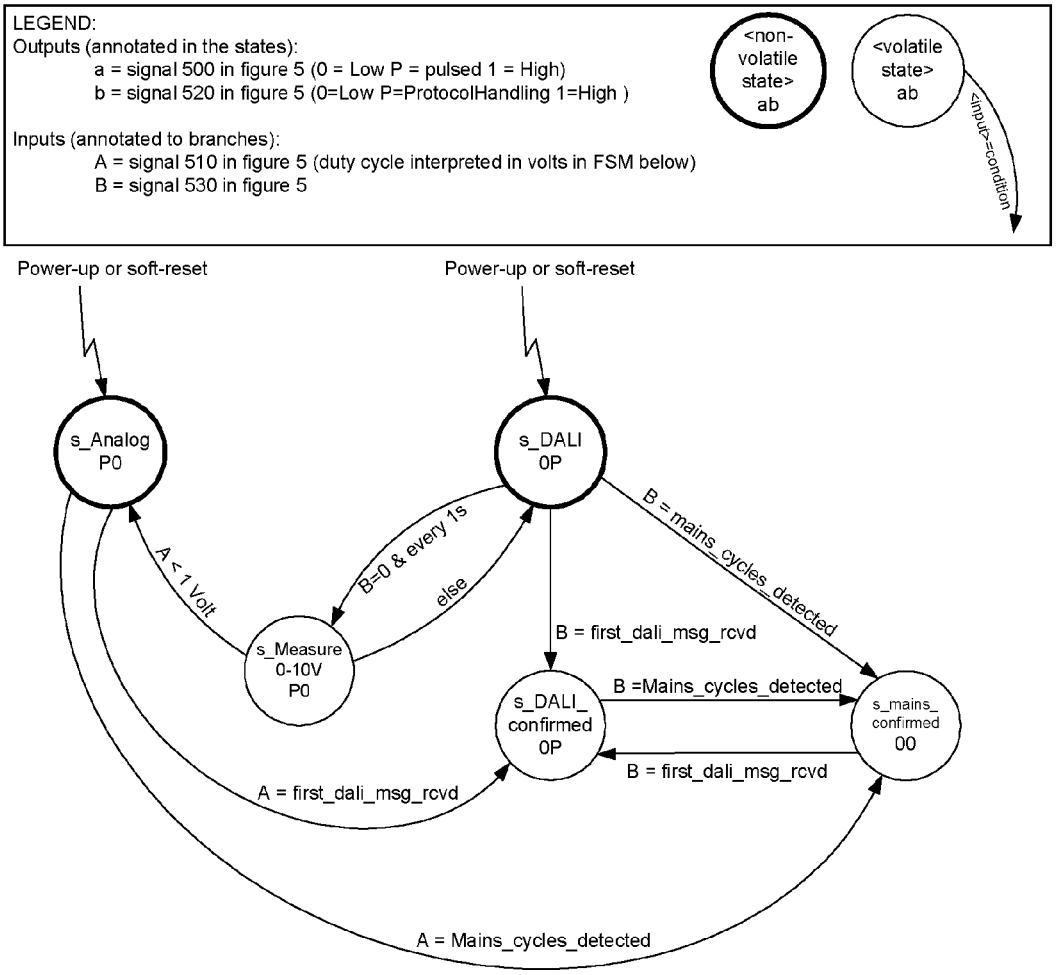
FIG. 7 schematically depicts a first finite state machine diagram illustrating how the type of input signal can be detected.
Figure 8:
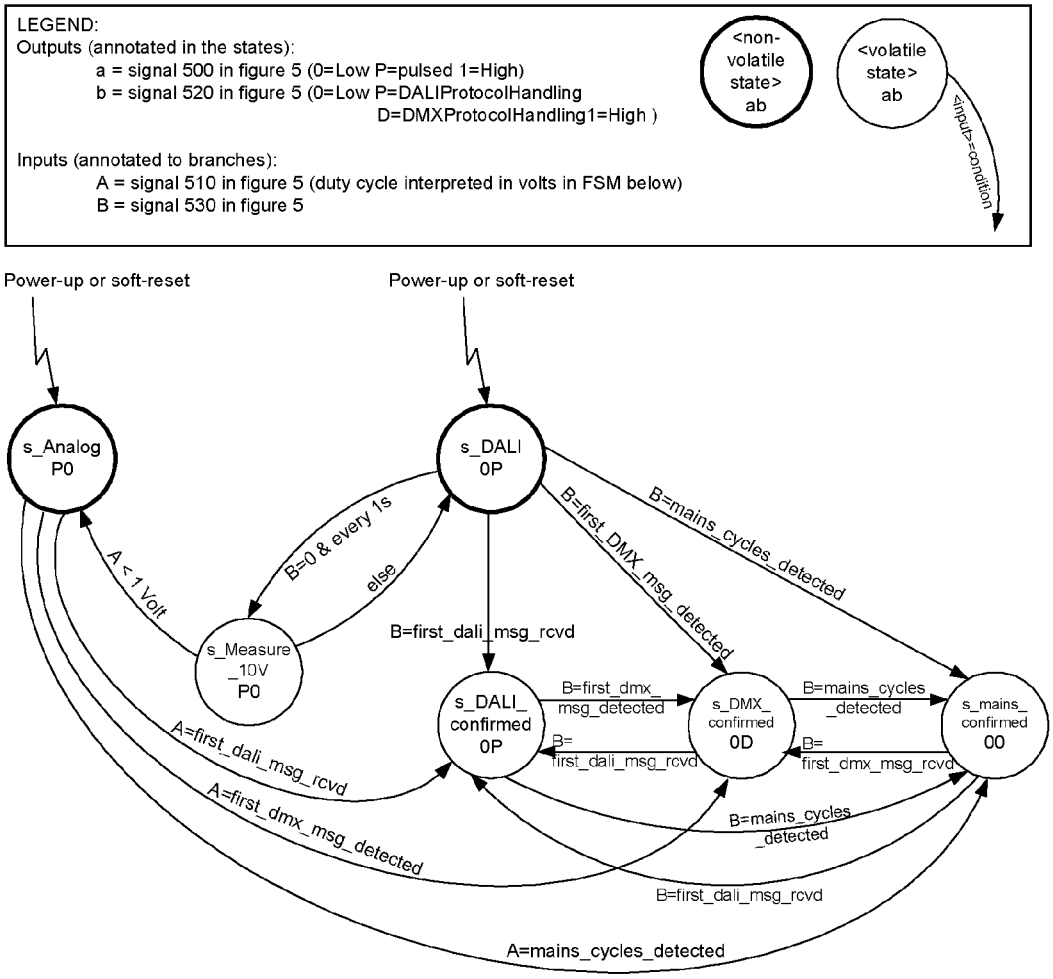
FIG. 8 schematically depicts a second finite state machine diagram illustrating how the type of input signal can be detected.

FIGS. 7 and 8 schematically depict possible ways of determining the kind of input signal applied by means of finite state machine diagrams.

As a first example of how to detect the kind of input signal applied, reference is made to the following finite state machine diagram (FIG. 7) describing an embodiment of a way of determining the kind of input signal applied, the finite state machine further on being referred to as FSM2:

In the state diagrams of FIGS. 7 and 8, the bold circles represent non-volatile states, whereas the other circles represent states stored in a volatile memory, as also indicated in the legend of the diagrams.

Upon power-up or upon a soft reset, the interface can start in either the analogue mode (s_Analog) or the DALI mode (s_DALI) depending on the content of the non-volatile memory. When, starting from either of these states, a message having a format according to the DALI protocol is received, the interface will proceed to operate in the s-DALI_confirmed mode whereby the incoming signals are interpreted as input signals according to the standard DALI protocol.

Alternatively, when, during operation in either the analogue mode (s_Analog) or the DALI mode (s_DALI) a mains input signal is detected, the interface will proceed to operate in a mains_confirmed state whereby the mains signal can be converted to switch-dim pulses which are subsequently passed via a DALI output terminal. Alternatively, depending on where the detection of the type of input signal takes place a distinction between the detection of a standard DALI message, an analogue 0-10V signal and a switch-dim signal may equally occur, rather than the detection of a mains signal.

As further indicated, when the interface starts in DALI mode, it is checked, e.g. once every second, if a DALI message is received. If not, the interface switches to a measure state (s_measure) whereby the input voltage is measured. When this voltage is found to be less than 1 V, the interface will proceed to operate in the analogue mode (s_Analog).

In FIG. 8, another finite state machine is schematically depicted, whereby the detection of a fourth type of signal (DMX) is possible (FSM4).

The FSM's as shown are intended to describe how an input signal is addressed by either the detection in a microcontroller implemented in an LED driver or an microcontroller implemented in a separate microcontroller, which can e.g. be available in the interface (hardwired) or via a galvanic separation.

The objective which can be realised by the interface circuit according to the invention may further be understood as follows:

When a new lighting application is installed or a retrofitting is applied, the lighting application should be capable of accepting a set point (indicative of a desired illumination parameter) in at least the following formats:

0-10V analoog
DALI
Switch-dim (switched mains) and optionally
DMX

A further objective, which can e.g. be realised by the exemplary FSMs as described is to ensure that, once a particular type of input signal is identified, the interface maintains in the same operating state, until a power-off or a reset of the installation occurs. As such, as soon as a DALI message or switch-dim (of DMX) is detected, the input signal is processed, by the converter circuit, accordingly, until a power-off or a reset occurs. By doing so, the detection circuit need not monitor continuously whether a different type of input signal is presented. This prevents any switching or changing of operating state (e.g. from 0-10V to DALI/switch-dim) which could result in switching effects on the current as exchanged between the lighting application and the interface. Therefore, upon installation the start-up mode or state of the FSM will e.g. be the s_Analog state opkomt. Referring to the FSMs as described above, this could result in only a signal being present on input A because signal 500 via 222 disables the DALI/switch-dim detection. When, during subsequent operation, indeed a 0-10V signal is observed (which can be assessed by analysing the PWM DUTY CYCLE signal 510), the operating remains in the s_Analog state and the signal observed at terminal A (signal 510) can be used to generate a setpoint between 0% and 100% for the lighting application co-operating with the interface. As an example, the normal duty cycle timing and amplitude observed when an analogue 0-10V input signal is applied, can e.g. correspond to a 20 kHz duty cycling whereby 90% dutycycle corresponds to 10V en 1V corresponds to 10% dutycycle. (in this example, the 1-10V range of the 0-10V signal can be used to accommodate a set-point between 0% and 100% whereas a 0V signal may be used as a command to power-off the lighting application).

In case the detected signal does not have the expected duty cycle timing, it can be assumed that a DALI protocol message is presented as an input signal, rather than an analogue 0-10V signal.

As the DALI signal is, in general, >10 V, the PWM DUTY CYCLE signal 510 as observed will be high during approx. 100% of the time. As such, this may be an indication that the input signal is not an analogue 0-10V signal.

Similarly, in case the input signal is a switch-dim signal, the PWM DUTY CYCLE signal 510 as observed will be high during approx. 100% of the time Once it is clear that the presented signal is not an analogue 0-10V signal, the interface can switch to operating in the appropriate mode; i.e. the detection circuit may provide the required control signals 221,222,223. When operating in the DALI or switch-dim mode, the current source as indicated in FIGS. 5 and 6 can e.g. be switched off.

Upon a subsequent power-off of the installation or a reset, the FSM returns to its initial state s_analog in case the FSM was either operating in s_Analog or s_Measure prior to the power off or reset. Otherwise, the FSM remains in the s_DALI state.

It is worth noting that the above described FSMs merely represent a few examples on how detection of various types of input signals and subsequent operation in different states (depending on the type of input signal) can be organized. Other embodiments are thus feasible without departing from the scope of the present invention.

In accordance with the present invention, an interface is provided that facilitates installation, e.g. retrofitting of lighting devices such as LED fixtures. The interface enables lighting devices to be controlled by a variety of know input signals, which input signals may, according to the invention, be provided at a single input terminal of the interface. As such, installation is facilitated. In accordance with the present invention, the interface is adapted to at least process the following types of input signals:

a DALI protocol signal, an analogue signal according to the 0-10V standard, a mains signal.

The advantages of such an interface and its implementation are:

Introduction of DALI devices in 0-10V installations is possible with low effort.

Replace 0-10V lighting fixtures with fixtures having the interface circuit according to the invention. This works without changing wiring. The installation will work as previous.

(Note that existing cabling must honor electrical isolation of f.e. 1.5 or 4 kV between 0-10V signal wires and mains wires and will therefore be adequate for the tri-modal interface)

At the time all fixtures have been replaced, replace the 0-10V source(s) with DALI source. The installation will work as previous.

(This opens the road for gradually augmenting the installation with DALI enabled extra features.)

Lower cost than prior art solutions such as described in US 2010/0060194.

Less connector resources are needed.

In a DALI compatible fixture having separate 0-10V interfacing, electrical isolation must be present between the 0-10V and the mains, between the DALI interface and the mains and between the 0-10V and DALI interface. By routing the 0-10V over the DALI wires in case of the tri-modal interface, only the electrical isolation between the tri-modal interface and the mains networks need to be implemented. This saves on cost and space.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

A single processor or other unit may fulfil the functions of several items recited in the claims.

The invention claimed is:

1. An interface circuit for a lighting device, the interface circuit comprising:

a single input terminal connectable to one of a plurality of signal sources, each source providing a respective one of an analogue 0-10V signal, a DALI protocol signal, and a mains signal, to receive an input signal;

an output terminal;

a detection circuit to receive the input signal or a signal representative thereof and identify whether the input signal is either an analogue 0-10V signal, a DALI protocol signal or a mains signal, and a converter circuit to convert the input signal to a control signal based on the identification, and to provide the control signal to the output terminal to control the lighting device.

2. The interface circuit according to claim 1, wherein the converter circuit further comprises a voltage limiter circuit to convert a mains signal received at the input terminal to a control signal comprising an array of switch-dim pulses.

3. The interface circuit according to claim 2, wherein the converter circuit further comprises a PWM circuit for converting an analogue 0-10V signal received at the input terminal to a control signal comprising a PWM signal.

4. The interface circuit according to claim 3, wherein the detection circuit is arranged to enable the PWM circuit based on the identification of the input signal.

5. The interface circuit according to claim 1, wherein the converter circuit further comprises a PWM circuit for converting an analogue 0-10V signal received at the input terminal to a control signal comprising a PWM signal.

6. The interface circuit according to claim 5, wherein the detection circuit is arranged to enable the PWM circuit based on the identification of the input signal.

7. The interface circuit according to claim 1, further comprising a current source for providing a current at the input terminal.

8. The interface circuit according to claim 7, wherein the detection circuit is arranged to control the current source based on the identification of the input signal.

9. The interface circuit according to claim 1, further comprising an opto coupler connected at the output terminal.

10. The interface circuit according to claim 1, wherein the detection circuit is further arranged to identify whether the input signal is a DMX signal.

11. The interface circuit according to claim 1, wherein the detector circuit is galvanically separated from the converter circuit.

12. An interface circuit for a lighting device, the interface circuit comprising:

a single input terminal connectable to one of a plurality of signal sources, each source providing, a respective one of an analogue 0-10V signal, a DALI protocol signal, and a mains signal, to receive an input signal;

an output terminal;

a detection circuit to receive the input signal or a signal representative thereof and identify whether the input signal is either an analogue 0-10V signal, a DALI protocol signal or a DMX signal and a converter circuit to convert the input signal to a control signal based on the identification, and provide the control signal to the output terminal to control the lighting device.

13. The interface circuit according to claim 12, wherein the detection circuit is arranged to identify the input signal based on the amplitude of the input signal.

14. The interface circuit according to claim 13, wherein the detection circuit is arranged to identify the input signal based on a detection of an impedance of a source providing the input signal.

15. The interface circuit according to claim 14, further comprising a current source for injecting a current at the input terminal to determine the impedance.

16. The interface circuit according to claim 12, wherein the detection circuit is arranged to identify the input signal based on a detection of an impedance of a source providing the input signal.

17. The interface circuit according to claim 16, further comprising a current source for injecting a current at the input terminal to determine the impedance.

* * * * *